US005510565A

United States Patent [19]

Tan et al.

[11] Patent Number: 5,510,565

[45] Date of Patent: Apr. 23, 1996

[54] MERCURY REMOVAL FROM LIQUID HYDROCARBON FRACTION

[75] Inventors: Shoji Tan, Chiba; Yukimasa Shigemura, Tokyo; Shinji Abe; Junichi Narita, both of Chiba, all of Japan

[73] Assignee: Mitsui Petrochemical Industries, Ltd., Tokyo, Japan

[21] Appl. No.: 360,428

[22] Filed: Dec. 21, 1994

[30] Foreign Application Priority Data

Dec. 22, 1993 [JP] Japan ..... 5-324388
Nov. 22, 1994 [JP] Japan ..... 6-287766

[51] Int. Cl.[6] ..... C07C 7/12

[52] U.S. Cl. ..... 585/823; 585/802; 585/830; 585/853

[58] Field of Search ..... 585/802, 823, 585/830, 853

[56] References Cited

U.S. PATENT DOCUMENTS 5,062,948 11/1991 Kawazoe et al. ..... 585/822
5,202,301 4/1993 McNamara ..... 502/417
5,389,234 2/1995 Bhargara et al. ..... 208/131

FOREIGN PATENT DOCUMENTS 52-90502 7/1977 Japan .
3-28295 2/1991 Japan .
3-213144 9/1991 Japan .

*Primary Examiner*—Sharon Gibson
*Attorney, Agent, or Firm*—Birch, Stewart, Kolasch & Birch

[57] ABSTRACT

Mercury is removed from a liquid hydrocarbon fraction by effecting high-temperature heat treatment to convert an organic mercury compound into an inorganic mercury compound or elemental mercury, removing a higher molecular weight component from the fraction, removing water from the fraction, and thereafter contacting the fraction with an adsorbent in the form of active carbon having calcium or a calcium compound supported thereon. Although only a minor amount of mercury is contained in the liquid hydrocarbon fraction, mercury can be efficiently removed at low cost on an industrial large scale, achieving an extremely low mercury concentration.

9 Claims, 3 Drawing Sheets

MERCURY REMOVAL FROM LIQUID HYDROCARBON FRACTION

BACKGROUND OF THE INVENTION

1. Field of the Invention

This invention relates to a method for removing mercury from a hydrocarbon fraction and more particularly, to a method for highly efficient removal of mercury from a hydrocarbon fraction which contains a small amount of mercury and can be handled in a liquid state on a commercial scale (to be referred to as "liquid hydrocarbon fraction" hereinafter).

2. Description of the Related Art

Previously, mercury removal techniques were developed and established as pollution control measures in order to remove toxic mercury from waste water and exhaust gases. A variety of techniques were available for removing mercury from water and gases.

Palladium supported on alumina and similar catalysts are often used in reforming a petroleum fraction or similar liquid hydrocarbon fraction through hydrogenation or the like. It is known that if mercury is present in the hydrocarbon fraction as an incidental impurity, the catalyst is poisoned such that modification may not fully take place.

For removal of mercury from a liquid hydrocarbon fraction, for example, Japanese Patent Application Kokai (JP-A) No. 90502/1977 discloses a method for removing mercury from vacuum pump oil by adding zinc sulfide to the oil, allowing the zinc sulfide to adsorb and collect mercury, and thereafter separating the mercury along with the excess zinc sulfide. JP-A 28295/1991 discloses use of an adsorbent in the form of active carbon having cupric chloride or stannous chloride supported thereon. JP-A 213144/1991 discloses use of an adsorbent in the form of active carbon having supported thereon halides of metal elements of Group I or II in the Periodic Table.

However, the method of JP-A 90502/1977 results in a vacuum pump oil having a mercury concentration of about 5 to 3 parts by weight per million parts by volume. This mercury removal is still insufficient. The method of JP-A 28295/1991 can be applied to only a limited range of hydrocarbon compounds. Due to the danger that copper acetylide might be formed, it is dangerous to use cupric chloride in treating a hydrocarbon which may contain acetylene. Stannous chloride to be supported on active carbon has a low solubility in water and requires the addition of hydrochloric acid in order that it may be applied or deposited to active carbon. It is difficult to remove the hydrochloric acid. As a result, the range of hydrocarbons to which this method is applicable is limited. The method of JP-A 213144/1991 has the problem that an organic mercury compound in the liquid hydrocarbon fraction is little adsorbed by the Group I or II metal halides. This method achieves a mercury removal of about 50 to 70%. It is difficult to efficiently remove mercury from the liquid hydrocarbon fraction. None of the currently available techniques can be practiced at a reasonable cost on a commercial large scale.

SUMMARY OF THE INVENTION

Therefore, a first object of the present invention is to provide a mercury removal method which can remove mercury from a liquid hydrocarbon fraction on a commercial scale to achieve an extremely low mercury concentration of below about 0.001 ppm.

A second object of the present invention is to provide a mercury removal method applied to a liquid hydrocarbon fraction containing mercury in the form of an organic mercury compound, which can efficiently remove mercury from the liquid hydrocarbon fraction on a commercial scale to achieve an extremely low mercury concentration of below about 0.001 ppm. Hereinafter, ppm is parts by weight of mercury per million parts by weight of the liquid hydrocarbon fraction.

For achieving the first object, the present invention provides a method for removing mercury from a liquid hydrocarbon fraction which contains some water and a component having a higher molecular weight than the desired hydrocarbon compound along with mercury, which involves the steps of (a) removing the higher molecular weight component from the fraction, (b) removing water from the fraction, and thereafter (c) contacting the fraction with an adsorbent, thereby removing mercury from the fraction through adsorption. The adsorbent used in step (c) is active carbon having at least one of calcium and a calcium compound supported thereon.

For achieving the second object, the present invention provides a method for removing mercury from a liquid hydrocarbon fraction which contains an organic mercury compound, which involves the steps of (1-*a*) subjecting the fraction to high-temperature heat treatment and thereafter (c) contacting the fraction with an adsorbent. The high-temperature heat treatment (1-*a*) is to convert the majority of the organic mercury compound into an inorganic mercury compound or elemental mercury.

In another aspect, mercury is removed from a liquid hydrocarbon fraction which contains some water, a component having a higher molecular weight than the desired hydrocarbon compound and an organic mercury compound, by (1-*a*) subjecting the fraction to high-temperature heat treatment, (a) then removing the higher molecular weight component from the fraction, (b) removing water from the fraction, and thereafter (c) contacting the fraction with an adsorbent.

In a further aspect, mercury is removed from a liquid hydrocarbon fraction which contains a component having a higher molecular weight than the desired hydrocarbon compound and an organic mercury compound, by (1-*a*) subjecting the fraction to high-temperature heat treatment, (a) then removing the higher molecular weight component from the fraction, and thereafter (c) contacting the fraction with an adsorbent.

In a still further aspect, mercury is removed from a liquid hydrocarbon fraction which contains some water and an organic mercury compound, by (1-*a*) subjecting the fraction to high-temperature heat treatment, (b) then removing water from the fraction, and thereafter (c) contacting the fraction with an adsorbent.

Preferably, the calcium compound is a calcium halide or calcium oxide and the active carbon is of particulate form having a particle size of 4 to 120 mesh.

DETAILED DESCRIPTION OF THE INVENTION

Figure 1:
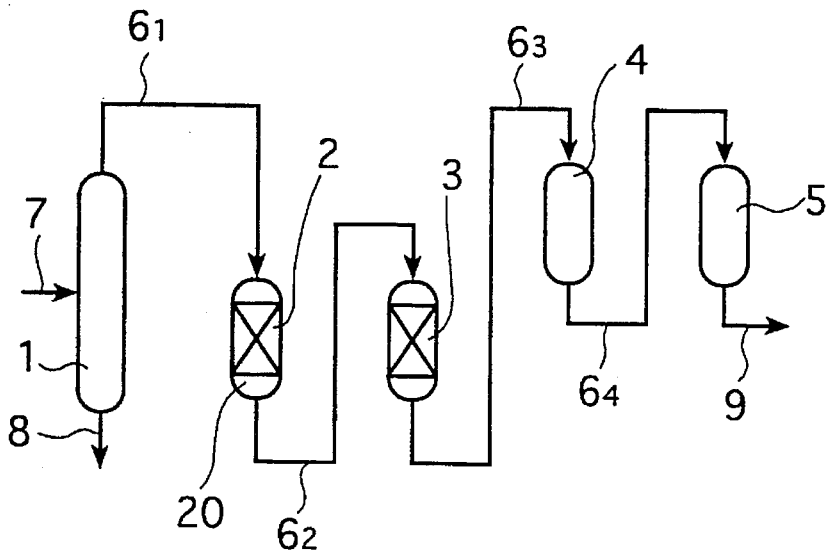
FIGS. 1 to 4 are block diagrams illustrating different embodiments of the invention.

Now the method for removing mercury from a liquid hydrocarbon fraction according to the invention is described in detail.

The liquid hydrocarbon fraction to which the method of the present invention is applicable may be of any desired origin as long as it can be handled in a liquid state on a commercial scale. The liquid hydrocarbon fraction may be a single hydrocarbon compound or a mixture of hydrocarbon compounds. Exemplary liquid hydrocarbon fractions are liquefied natural gas (LNG), hydrocarbon compounds derived from petroleum, and hydrocarbon compounds derived from coal. When the hydrocarbon fraction is a low boiling fraction composed mainly of ethylene or propylene, it should be processed under a sufficient pressure to maintain it in a liquid state. When the hydrocarbon fraction is a fraction which is liquid at approximately room temperature and atmospheric pressure, for example, crude oil, heavy oil, straight run naphtha, kerosene, and gas oil, it may be processed as such at room temperature and atmospheric pressure. When the hydrocarbon fraction is mainly composed of a hydrocarbon compound which is solid at room temperature, it can be heated into a liquid state before it is processed. The method of the present invention is useful particularly in processing liquefied natural gas (LNG), liquefied petroleum gas (LPG) and liquefied olefins such as liquefied ethylene and liquefied propylene. Often the liquid hydrocarbon fraction contains some water and a component having a higher molecular weight than the desired hydrocarbon compound along with mercury.

Mercury to be removed from the liquid hydrocarbon fraction may be present in any form in the liquid hydrocarbon fraction. For example, mercury is present in elemental form or as an inorganic mercury compound or organic mercury compound in the liquid hydrocarbon fraction.

The concentration of mercury in the starting liquid hydrocarbon fraction is not critical. When applied to either a liquid hydrocarbon fraction containing much mercury or a liquid hydrocarbon fraction containing a trace amount of mercury, the inventive method is effective for removing mercury from the liquid hydrocarbon fraction to reduce the mercury concentration to an extremely low level. Particularly when applied to a liquid hydrocarbon fraction containing about 0.002 to 10 ppm of mercury, the inventive method is effective for removing mercury therefrom.

According to the inventive method, the liquid hydrocarbon fraction is subject to step (a) of removing a higher molecular weight component from the fraction and step (b) of removing water from the fraction. Steps (a) and (b) may be carried out either simultaneously or separately. In the latter case, either step (a) or (b) may be the first step. Step (a) is to remove those hydrocarbon compounds having a higher molecular weight than the desired hydrocarbon compound from the starting liquid hydrocarbon fraction. In the inventive method, step (a) is effective for preventing a higher molecular weight component such as tar from depositing on active carbon to cover the surface of active carbon therewith, that is, for preventing active carbon from losing its mercury adsorption capability. Step (b) is effective for preventing the adsorbent from adsorbing water because otherwise active carbon would lose its adsorption capability and the supported substance would flow away.

Often, mercury is contained in the liquid hydrocarbon fraction in the form of an organic mercury compound. When mercury is removed from a liquid hydrocarbon fraction containing mercury as an organic mercury compound, the fraction is first subject to step (1-*a*) of high-temperature heat treatment to convert the majority, preferably at least 80% of the organic mercury compound into an inorganic mercury compound or elemental mercury. Step (1-*a*) is generally followed by step (a) of removing a higher molecular weight component from the fraction and/or step (b) of removing water from the fraction. In an embodiment wherein a liquid hydrocarbon fraction is previously subjected to high-temperature heat treatment (1-*a*) to convert the majority of an organic mercury compound into an inorganic mercury compound or elemental mercury, a higher molecular weight component and water can also be removed from the liquid hydrocarbon fraction at the same time as the high-temperature heat treatment. In such an embodiment, steps (a) and (b) may be omitted. The inventive method may further involve, prior to step (a), a step of simultaneously separating a lower molecular weight component from the fraction such that the final fraction resulting from mercury removal step (c) can be used as a source material in a subsequent step without a special treatment for increasing the purity of a useful component.

In the embodiment wherein a liquid hydrocarbon fraction containing an organic mercury compound is previously subjected to high-temperature heat treatment (1-*a*) to convert the majority of the organic mercury compound into an inorganic mercury compound or elemental mercury, the temperature of this high-temperature heat treatment is generally about 200° to 900° C., preferably about 400° to 900° C., more preferably about 700° to 900° C. If the heat treating temperature is above 900° C., a problem arises with respect to the heat resistance of the heating furnace and much carbon would undesirably deposit on the inner surface of the heating furnace. The time of the high-temperature heat treatment is generally 0.1 second or more although it may be properly selected depending on the content of organic mercury compound, the decomposition state of hydrocarbons, and the deposition of carbon on the furnace wall. The manner of high-temperature heat treatment is not particularly limited and conventional equipment and procedure may be used. For example, a tubular furnace or vessel type furnace may be used. When the inventive method is applied to an existing plant designed to crack a hydrocarbon fraction such as heavy oil and straight run naphtha in a thermal cracking furnace to produce ethylene, propylene, etc., the cracking step in the cracking furnace can also serve as step (1-*a*). Advantageously step (1-*a*) can be effected with the existing plant without a need for a special unit for step (1-*a*).

The "higher molecular weight component" used herein is a component contained in the starting liquid hydrocarbon fraction and having a higher molecular weight than the desired hydrocarbon product. Where the desired hydrocarbon product is a low boiling oil having 2 to 4 carbon atoms, the higher molecular weight component is those hydrocarbons having 5 or more carbon atoms. Similarly, where the desired hydrocarbon product is a medium boiling oil having 6 to 8 carbon atoms, the higher molecular weight component is those hydrocarbons having 9 or more carbon atoms.

In the inventive method, step (a) of removing a higher molecular weight component and step (b) of removing water can be conventionally effected. These removal techniques are not critical. Removal in steps (a) and (b) may be effected by distillation, filtration, adsorption to molecular sieves, or adsorption to zeolite although the removal means is not limited thereto.

In the inventive method, step (a) of removing a higher molecular weight component and step (b) of removing water are preferably carried out such that the resulting liquid hydrocarbon fraction may have a water concentration below the solubility, a substantially zero content of free water, and a higher molecular weight component content of less than 30 mol %, more preferably less than 10 mol %, most preferably less than 1 mol %. Where the desired hydrocarbon product is a hydrocarbon having 3 carbon atoms, for example, step (a) is preferably carried out to remove the higher molecular weight component having 4 or more carbon atoms such that its residual content may be less than 30 mol %.

After step (1-*a*) of high-temperature heat treatment, step (a) of removing a higher molecular weight component and step (b) of removing water from a liquid hydrocarbon fraction, the inventive method involves a step (c) of removing mercury. This mercury removing step (c) uses an adsorbent in the form of active carbon having calcium or a calcium compound supported thereon and brings the fraction in solid-liquid contact with the adsorbent, thereby removing mercury from the fraction.

The active carbon used as a support of the adsorbent is conventional active carbon in granular or powdery form. Steam activated carbon is also useful. Preferred active carbon has a pore size of 10 to 500 Å, especially 10 to 100 Å and a specific surface area of 100 to 1,500 $m^2/g$, especially 800 to 1,200 $m^2/g$. Active carbon having physical dimensions within these ranges can more efficiently remove mercury.

Often unsaturated compounds such as diene compounds are contained in the liquid hydrocarbon fraction. When a liquid hydrocarbon fraction containing such unsaturated compounds is treated with active carbon, there is a chance that due to heat of adsorption, the unsaturated compounds can thermally polymerize to form a polymer within pores of the active carbon. The polymer once formed prohibits further adsorption of mercury to active carbon. In order to prevent formation of such a polymer and to allow active carbon to effectively adsorb mercury, the active carbon used as a support of the adsorbent in the practice of the invention is preferably one having a sufficiently small particle size to facilitate heat removal. A too small particle size is undesirable because powder dust generated and an undesirable pressure loss occurs in the adsorption column. For this reason, the preferred active carbon has a particle size of 4 to 120 mesh, more preferably 10 to 60 mesh.

The calcium component supported on active carbon is selected from elemental calcium and calcium compounds alone or in admixture of two or more. Exemplary calcium compounds are calcium halides such as $CaCl_2$, $CaF_2$ and $CaI_2$, and calcium oxide. Preferred among these are calcium halides, especially calcium chloride ($CaCl_2$). Preferably the calcium component is deposited on active carbon in an amount of 0.1 to 30% by weight based on the weight of the support (active carbon).

The amount of the adsorbent used depends on the desired concentration of mercury after treatment, the replacement frequency of the adsorbent, and the particular type of adsorbent. For example, if a liquid hydrocarbon fraction has a mercury concentration of 0.01 ppm after removal of the higher molecular weight component and water, the adsorbent is used in such an amount that there is available about 10 to 1,000 grams of the active component or calcium component in the adsorbent per gram of mercury in the liquid hydrocarbon fraction.

In the practice of the invention, the adsorbent may be used by loading a fixed-bed adsorption column therewith. Usually, the liquid hydrocarbon fraction is passed through a drum which is packed with adsorbent granules.

For preparing the adsorbent, any desired technique may be used by which the calcium component can be supported on active carbon as a support. In one exemplary technique (1), an adsorbent having a calcium halide supported on active carbon is prepared by dissolving the calcium halide in a suitable solvent, for example, inorganic solvents such as aqueous solution, hydrochloric acid aqueous solution, and alkaline aqueous solution, and organic solvents such as acetone and alcohols, immersing the support in the resulting solution, and evaporating the solvent from the support by means of an evaporator or the like. After drying, the calcium halide-laden adsorbent is obtained. In another technique (2), an adsorbent having a calcium oxide supported on active carbon is prepared by immersing a support in a calcium solution, evaporating the solvent from the support by means of an evaporator or the like, thereby drying the support, and calcining the support in an oxygen-existent atmosphere to form calcium oxide.

Any desired apparatus may be used for practicing the inventive method for removing mercury from a liquid hydrocarbon fraction. The choice of apparatus depends on the concentration of mercury in a starting liquid hydrocarbon fraction, the desired throughput, and the manner of replacing the adsorbent. A choice may be made among adsorption columns having a fixed bed of the adsorbent, systems using a moving bed, and systems using a fluidized bed, for example. Preferred among these systems are adsorption columns. Included are a single adsorption column system, a switchable dual adsorption column system, a serially connected adsorption column system, and a switchable system of two or more parallel connected adsorption columns. The adsorption column equipped with a fixed bed is advantageous in that a liquid hydrocarbon fraction can be continuously passed therethrough for continuous processing.

In removing mercury by adsorption, the temperature generally ranges from about 10° to about 150° C. preferably from about 20° to about 100° C. The pressure generally ranges from atmospheric pressure to 100 $kgf/cm^2G$, preferably from atmospheric pressure to 30 $kgf/cm^2G$. The average residence time of the liquid hydrocarbon fraction in the mercury removing unit is generally adjusted to about 45 to 1,200 seconds, preferably about 90 to 360 seconds. The linear velocity of the liquid hydrocarbon fraction through the mercury removing unit generally ranges from about 0.001 to 0.1 m/s. The liquid hourly space velocity (LHSV) generally ranges from about 3 to 80 $h^{-1}$, preferably about 10 to 40 $h^{-1}$.

One exemplary embodiment of the inventive method is described by referring to a process involving mercury removal from a liquid hydrocarbon fraction in the form of a petroleum hydrocarbon fraction composed mainly of a hydrocarbon having 3 carbon atoms (to be simply referred to as "C3 fraction" hereinafter) and subsequent hydrogenation. The process is schematically illustrated in FIGS. 1 to 4.

The flow system illustrated in FIG. 1 includes a distillation column 1, a dehydration drum 2, a fixed-bed drum 3 for mercury removal, a first hydrogenation drum 4, and a second hydrogenation drum 5, connected through a transfer line 6 in a series flow arrangement. A feed line is connected to the distillation column 1 at a feed inlet located near the center of the column. A discharge line 8 is connected to the bottom of the distillation column 1 for discharging a higher molecular weight component. A transfer line section $\mathbf{6_1}$ is connected to the top of the column 1.

In this process, a charge hydrocarbons is fed from the feed line 7 to the distillation column 1 at the central inlet. With the higher molecular weight component, that is, C4 or higher fraction discharged through the discharge line 8, the C3 fraction is transferred from the distillation column 1 to the dehydration drum 2 through the transfer line section $\mathbf{6_1}$. Since the dehydration drum 2 is equipped with a fixed bed of zeolite, water is removed from the C3 fraction with the aid of zeolite while the C3 fraction is being passed through the fixed bed. A liquid charge outflowing from the bottom of the dehydration drum 2 is fed through a transfer line section $6_2$ to the mercury removing fixed-bed drum 3 where mercury is removed from the C3 fraction through adsorption to the adsorbent in the fixed bed. The C3 fraction from which mercury has been removed in this way is fed through a transfer line section $6_3$ to the first hydrogenation drum 4 and then through a transfer line section $6_4$ to the second hydrogenation drum 5 where the fraction is successively hydrogenated. Thereafter, the hydrogenated fraction is delivered as a final product to an outlet line 9.

Figure 2:
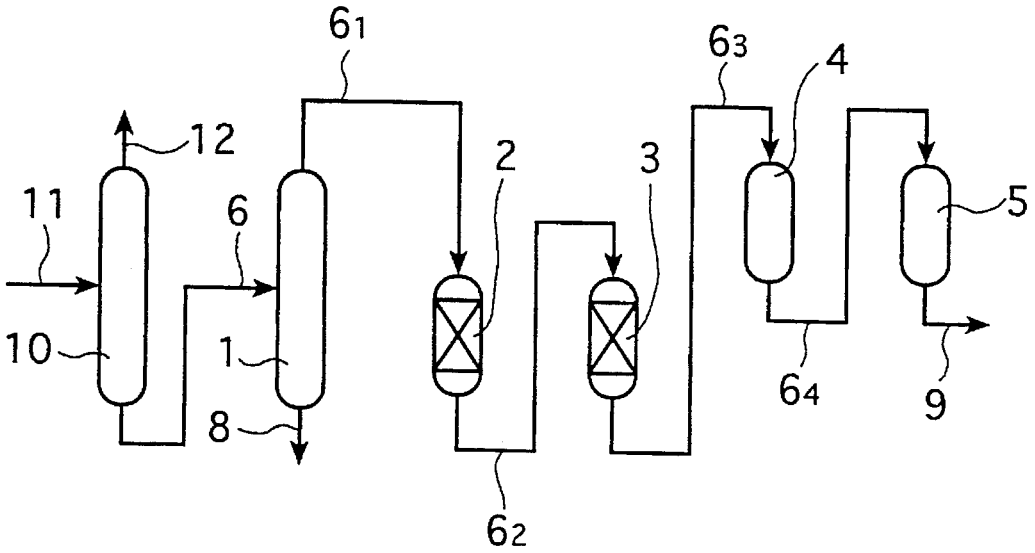

FIG. 2 illustrates addition of a pretreating step to the process of FIG. 1. A hydrocarbon charge is previously fed to an additional distillation column 10 where a lower molecular weight component is removed from the charge before it follows the same process as in FIG. 1 for mercury removal and hydrogenation.

More particularly, a charge of hydrocarbons is previously fed from a feed line 11 to a distillation column 10 where the charge is distilled. A lower molecular weight component is removed from the charge and discharged to a discharge line 12. The distilling temperature, pressure and reflux ratio in the distillation column 10 can be appropriately selected such that a lower molecular weight component may be selectively removed. The charge from which the lower molecular weight component has been removed is fed from the transfer line 6 to the distillation column 1 at the central inlet. Thereafter, the charge successively passes through the dehydration drum 2, mercury removing fixed-bed drum 3, first hydrogenation drum 4, and second hydrogenation drum 5 as in the process of FIG. 1. In the later process, the charge is subject to mercury removal and hydrogenation and then delivered as a final product to the outlet line 9.

Figure 3:
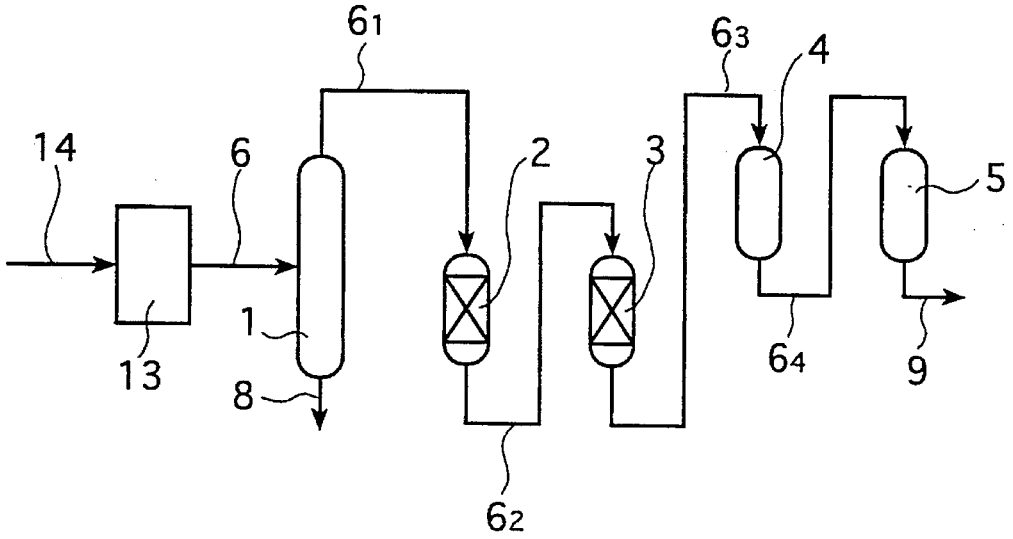

FIG. 3 illustrates addition of a high,temperature heat treatment step to the process of FIG. 1. A hydrocarbon charge is previously subject to high-temperature heat treatment in a heating furnace for converting an organic mercury compound into an inorganic mercury compound or elemental mercury before it follows the same process as in FIG. 1 for mercury removal and hydrogenation.

More particularly, a charge of hydrocarbons is previously fed from a feed line 14 to a heating furnace 13 where the charge is heated to a sufficiently high temperature to convert the organic mercury compound into an inorganic mercury compound or elemental mercury. The charge is then fed from the transfer line 6 to the distillation column 1 at the central inlet. Thereafter, the charge successively passes through the dehydration drum 2, mercury removing fixed-bed drum 3, first hydrogenation drum 4, and second hydrogenation drum 5 as in the process of FIG. 1. In the later process, the charge is subject to mercury removal and hydrogenation and then delivered as a final product to the outlet line 9.

Figure 4:
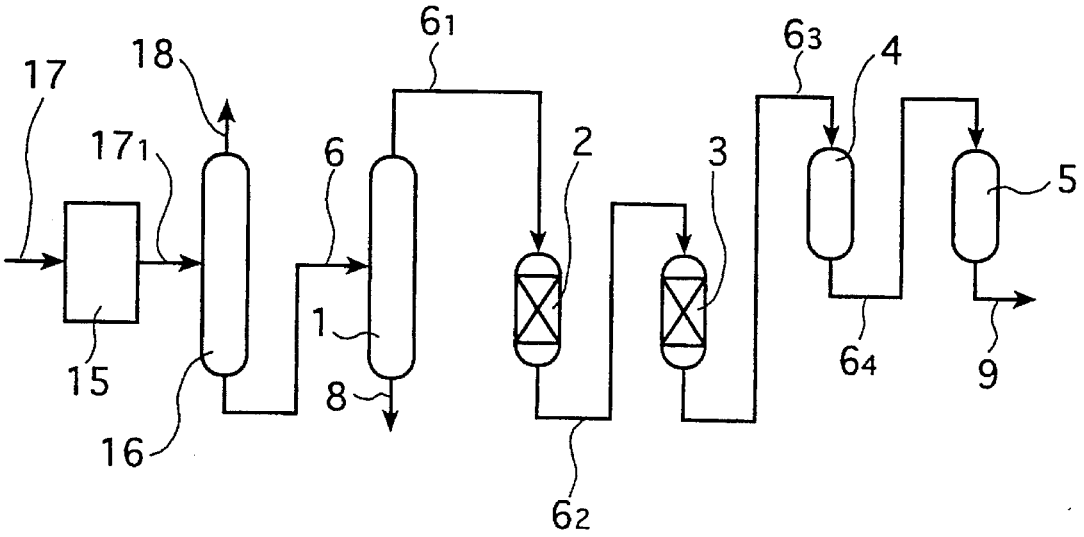

FIG. 4 illustrates addition of a high-temperature heat treatment step and a pretreating step to the process of FIG. 1. A hydrocarbon charge is previously subject to high-temperature heat treatment in a heating furnace 15 for converting an organic mercury compound into an inorganic mercury compound or elemental mercury and fed to a distillation column 16 where a lower molecular weight component is removed from the charge before the charge follows the same process as in FIG. 1 for mercury removal and hydrogenation.

More particularly, a charge of hydrocarbons is previously fed from a feed line 17 to a heating furnace 15 where the charge is heated to a sufficiently high temperature to convert the organic mercury compound into an inorganic mercury compound or elemental mercury. The charge is then fed through a feed line 171 to a distillation column 16 where the charge is distilled. A lower molecular weight component is removed from the charge and discharged to an exit line 18. The distilling temperature, pressure and reflux ratio in the distillation column 16 can be appropriately selected such that a lower molecular weight component may be selectively removed. The charge from which the lower molecular weight component has been removed is fed through the transfer line 6 to the distillation column 1 at the central inlet. Thereafter, the charge successively passes through the dehydration drum 2, mercury removing fixed-bed drum 3, first hydrogenation drum 4, and second hydrogenation drum 5 as in the process of FIG. 1. In the later process, the charge is subject to mercury removal and hydrogenation and then delivered as a final product to the outlet line 9.

The processes illustrated in FIGS. 1 to 4 represent different embodiments of the inventive method. If desired, a modification may be made to these embodiments, for example, by adding another separating step at an intermediate point in the process or at a last stage.

EXAMPLES

Examples of the present invention are given below by way of illustration and not by way of limitation.

With respect to mercury measurement, the overall amount of mercury was measured by cold vapor type atomic adsorption spectrometry with gold-Chromosorb adsorbent and the amount of organic mercury (mercury in organic mercury compound) was measured by cold vapor type atomic adsorption spectrometry with Chromosorb adsorbent. The amount of inorganic mercury (mercury in inorganic mercury compound and elemental mercury) was determined by subtracting the organic mercury amount from the overall mercury amount. The unit "ppm" is parts by weight per million parts by weight and "ppb" is parts by weight per billion parts by weight. Percents are by weight.

EXAMPLE 1 AND COMPARATIVE EXAMPLES 1–2

Figure 5:
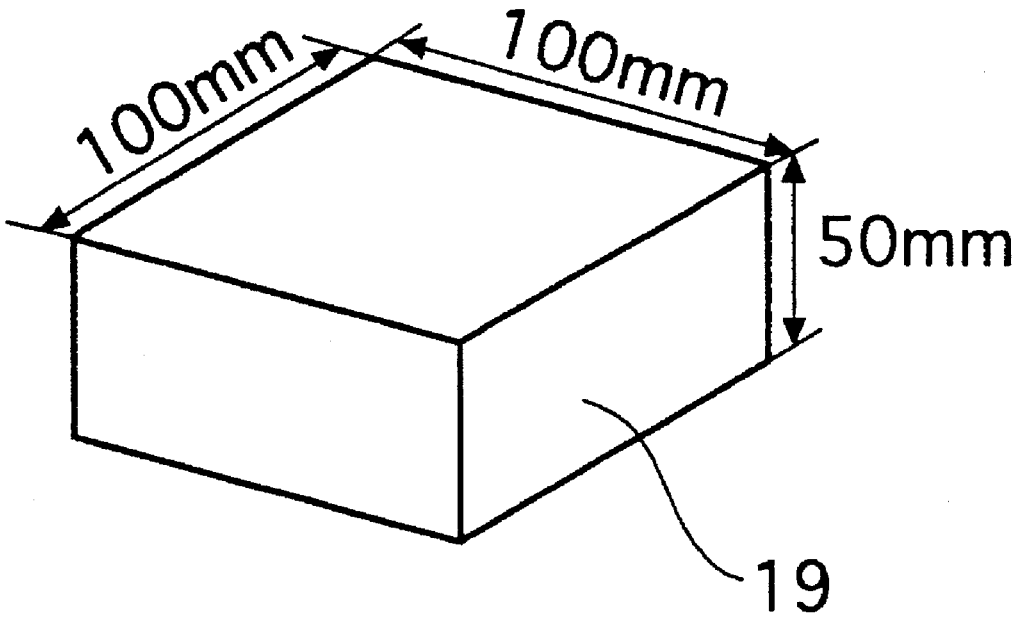
FIG. 5 is a perspective view of a sample filling container used in Example 1.

Sample packing containers 19 of 60-mesh stainless steel wire net having dimensions of 100×100×50 mm as shown in FIG. 5 were packed with the mercury removing adsorbents shown in Table 1. The adsorbent packed containers were placed in a test region 20 defined within the dehydration drum 2 near its bottom as shown in FIG. 1.

The mercury removing adsorbents shown in Table 1 were prepared as follows. The calcium chloride supported on active carbon in Example 1 and the cupric chloride supported on active carbon in Comparative Example 1 were prepared by dissolving calcium chloride or cupric chloride in water to form an aqueous solution, immersing active carbon (trade name CAL commercially available from Toyo Calgon K. K., specific surface area 1050 $m^2/g$, particle size 10–30 mesh) in the aqueous solution, and evaporating water for drying the active carbon. The stannous chloride supported on active carbon in Comparative Example 2 was prepared by suspending stannous chloride in water, adding aqueous hydrochloric acid to the suspension until the solution became clear, immersing active carbon (CAL) in the solution, and evaporating water for drying the active carbon.

The charge used was a liquid hydrocarbon fraction containing a C3 hydrocarbon component, a C4 and higher hydrocarbon component, some water, and a small amount of mercury. It was fed to the distillation column 1 where the C4 and higher hydrocarbon component was removed and then to the dehydration drum 2 where water was removed from the charge. At this point, the liquid hydrocarbon fraction contained 0.006 ppm of mercury, 40 ppm of a higher molecular weight component (C4 and higher hydrocarbon component), and 12 ppm of water. The liquid hydrocarbon fraction was then passed through the adsorbent-packed containers in order to find the tendency of mercury removing effect as a qualitative test. The conditions included a temperature of 10° C., a pressure of 10 kgf/cm$^2$G, a residence time of 4.4 sec., and an LHSV of 811 h$^{-1}$. At the end of operation, the weight of mercury adsorbed in the adsorbent was measured. The mercury removal was rated "Excellent" when the weight of mercury in the adsorbent was 120 ppm or more and "Good" when the weight of mercury in the adsorbent was 80 to less than 120 ppm. The results are shown in Table 1.

TABLE 1

| | Adsorbent | Hg in adsorbent (ppm) | Rating |
|---|---|---|---|
| E 1 | 5% $CaCl_2$ supported on active carbon | 130 | Excellent |
| CE 1 | 10% $CuCl_2$ supported on active carbon | 80 | Good |
| CE 2 | 10% $SnCl_2$ supported on active carbon | 110 | Good |

As is evident from Table 1, the adsorbent of Example 1 adsorbed more mercury and provided a higher rate of mercury removal than the adsorbents of Comparative Examples 1 and 2 under the same conditions.

EXAMPLES 2–3 AND COMPARATIVE EXAMPLES 3–6

Two types of packing columns having a diameter of 1.5 inches and an interior volume of 250 ml and 1,000 ml were packed with each of the adsorbents prepared in Example 1 and Comparative Examples 1 and 2. A liquid hydrocarbon fraction based on a C3 component was passed through the packed column at a flow rate of 11.3 kg/h, a temperature of 10° C., and a pressure of 10 kgf/cm$^2$G. In the case of the 250-ml packed column, the residence time was 42 seconds and the LHSV was 85 h$^{-1}$. In the case of the 1000-ml packed column, the residence time was 168 seconds and the LHSV was 21 h$^{-1}$. Note that the liquid hydrocarbon fraction of C3 component used herein was one which had been subject to higher molecular weight component removal and water removal and contained 35 ppm of a higher molecular weight component (C4 and higher hydrocarbon component) and 5 ppm of water. For all of Examples 2–3 and Comparative Examples 3–6, the results of a test period of 7 days (continuous 168 hours) are shown in Table 2. The mercury removal was rated "Excellent" when the mercury concentration of the liquid hydrocarbon fraction at the outlet of the 250-ml column was 1 ppb or less and "Good" when the mercury concentration of the liquid hydrocarbon fraction at the outlet of the 250-ml column was from more than 1 ppb to 3 ppb.

TABLE 2

| | Adsorbent | Mercury concentration (ppb) in hydrocarbon fraction: Packed column inlet | 250 ml column outlet | 1000 ml column outlet | Rating |
|---|---|---|---|---|---|
| E 2 | 5% $CaCl_2$ supported on active carbon | 6 | 1 | ≦1 | Excellent |
| E 3 | 5% $CaCl_2$ supported on active carbon | 30 | 7 | 1 | Good |
| CE 3 | 10% $CuCl_2$ supported on active carbon | 6 | 2.4 | ≦1 | Good |
| CE 4 | 10% $CuCl_2$ supported on active carbon | 30 | 11 | 2.8 | |
| CE 5 | 10% $SnCl_2$ supported on active carbon | 6 | 2.2 | ≦1 | Good |
| CE 6 | 10% $SnCl_2$ supported on active carbon | 30 | 10 | 2.6 | |

As is evident from Table 2, Examples 2 and 3 achieved a lower mercury concentration at the column outlet than Comparative Examples 3 to 6 when the 250-ml column received an inlet mercury concentration of 6 ppb and 30 ppb. Examples 2 and 3 achieved a lower mercury concentration at the column outlet than Comparative Examples 4 and 6 when the 1000-ml column received an inlet mercury concentration of 30 ppb.

The results of Tables 1 and 2, combined with the previously mentioned practically unacceptable problems of the cupric chloride and stannous chloride supported on active carbon adsorbents used in Comparative Examples 3 to 6, reveal that the inventive method accomplishes more effective mercury removal than the Comparative Examples.

EXAMPLES 4–6

Packing columns of 5 cm in diameter and 1 m in length were packed with the mercury removing adsorbents shown in Table 3. These mercury removing adsorbents were prepared by pulverizing active carbon (trade name CAL, specific surface area 1050 m$^2$/g) and classifying the active carbon particles through screens into fractions of active carbon having the particle size shown in Table 3. The active carbon was immersed in an aqueous solution of calcium chloride, followed by water evaporation and drying as in Example 1.

Using the system shown in FIG. 4, a liquid hydrocarbon fraction containing mercury was processed. The fraction was fed to the heating furnace 15 where it was heat treated at 830° C. and then to the distillation columns 16 and 1 where the C3 and lower hydrocarbon component and the C5 and higher hydrocarbon component were successively removed, yielding a liquid hydrocarbon fraction (C4 fraction) containing 0.050 ppm of mercury. The C4 fraction was passed through the column packed with the mercury removing adsorbent at a temperature of 25° C., a pressure of 10 kgf/cm$^2$G, and a LHSV of 38 h$^{-1}$. Immediately before entry into the column, the C4 fraction contained 200 ppm of a higher molecular weight component (CS and higher component) and 15 ppm of water. Immediately before entry into the column, the proportion of inorganic mercury to overall mercury contained in the C4 fraction was 80%.

COMPARATIVE EXAMPLE 7

A packing column of 5 cm in diameter and 1 m in length was packed with the calcium chloride supported on active carbon adsorbent of 10–30 mesh. Without high-temperature heat treatment, distillation and water removal, a liquid hydrocarbon fraction containing 0.050 ppm of mercury was directly passed through the column packed with the mercury removing adsorbent at a temperature of 15° C., a pressure of 0.3 kgf/cm$^2$G, and a LHSV of 11 h$^{-1}$. Immediately before entry into the column, the proportion of organic mercury to overall mercury contained in the liquid hydrocarbon fraction was 95%.

TABLE 3

| | Adsorbent | Hg concentration at packed column inlet (ppm) | Break-through time* (day) |
|---|---|---|---|
| E 4 | 5% $CaCl_2$ supported on active carbon (particle size 10–30 mesh) | 0.050 | 60 |
| E 5 | 5% $CaCl_2$ supported on active carbon (particle size 30–60 mesh) | 0.050 | 70 |
| E 6 | 5% $CaCl_2$ supported on active carbon (particle size 4–8 mesh) | 0.050 | 10 |
| CE 7 | 5% $CaCl_2$ supported on active carbon (particle size 10–30 mesh) | 0.050 | ** |

*Breakthrough time is a time (days) taken from the start of feed until the mercury concentration of the liquid hydrocarbon fraction at the column outlet exceeded 0.002 ppm.
**After 1 day from the start of feed, the liquid hydrocarbon fraction had a mercury concentration of 0.044 ppm at the column outlet.

A comparison of the results of Example 4 and Comparative Example 7 shown in Table 3 reveals that an organic mercury compound is little adsorbed in the adsorbent as compared with an inorganic mercury compound or elemental mercury. When a liquid hydrocarbon fraction is first subject to high-temperature heat treatment for converting an organic mercury compound into an inorganic mercury compound or elemental mercury and then contacted with a mercury removing adsorbent, much more mercury can be effectively removed. The results of Examples 4 to 6 shown in Table 3 reveal that as the particle size of the adsorbent used is reduced from 4–8 mesh to 10–30 mesh and further to 30–60 mesh, the adsorbent has a longer life and a higher mercury adsorbing capacity.

EXAMPLES 7 AND 8

The charge used herein was a liquid hydrocarbon fraction containing mercury wherein organic mercury occupied 95% by weight of the overall mercury. The charge was fed into a glass tube of 6 mm in inner diameter and 1 m in height in a heating furnace where the charge was heat-treated at 400° C. (Example 7) or 600° C. (Example 8) for a residence time of ½ seconds. At the end of heat treatment, the proportion of inorganic mercury to overall mercury in the liquid hydrocarbon fraction was 94% (Example 7) or 96% (Example 8).

These results suggest that sufficient conversion of the organic mercury compound into a inorganic mercury compound or elemental mercury takes place even when the heat treating temperature is as low as 400° C. Then mercury can be removed at a high efficiency by contacting the liquid hydrocarbon fraction with the specific adsorbent according to the present invention.

There has been described a method for removing mercury from a liquid hydrocarbon fraction involving removal of a higher molecular weight component and removal of water followed by mercury removal whereby the mercury in the liquid hydrocarbon fraction, even when contained in a minor amount, can be efficiently removed on an industrial large scale to reduce the mercury concentration to an extremely low level of less than about 0.001 ppm. This mercury removal method is-efficient and cost effective. The capacity of a mercury removing unit such as an adsorption column can be maintained at an industrially acceptable level over a long period of time. The amount of adsorbent used can be reduced to an economically acceptable level.

Where a liquid hydrocarbon fraction contains an organic mercury compound, the fraction is previously subject to high-temperature heat treatment for converting the organic mercury compound into an inorganic mercury compound or elemental mercury. The pre-treatment ensures high efficiency removal of mercury by the inventive method.

Japanese Patent Application No. 324388/1993 is incorporated herein by reference.

Although some preferred embodiments have been described, many modifications and variations may be made thereto in the light of the above teachings. It is therefore to be understood that within the scope of the appended claims, the invention may be practiced otherwise than as specifically described.

What is claimed is:

1. A method for removing mercury from a liquid hydrocarbon fraction which contains an organic mercury compound, comprising the steps of:

(1-*a*) subjecting said fraction to heat treatment at a temperature of about 200° to 900° C. to convert the majority of the organic mercury into an inorganic mercury compound or elemental mercury, and thereafter (c) containing said fraction with an adsorbent in the form of active carbon having at least one of calcium and a calcium compound supported thereon, thereby removing mercury from said fraction.

2. A method for removing mercury from a liquid hydrocarbon fraction which contains some water, a component having a higher molecular weight than the desired hydrocarbon compound and an organic mercury compound, comprising the steps of:

(1-*a*) subjecting said fraction to heat treatment at a temperature of about 200° to 900° C. to convert the majority of the organic mercury compound into an inorganic mercury compound or elemental mercury, (a) then removing the higher molecular weight component from said fraction, and thereafter (b) removing water from said fraction, and thereafter (c) contacting said fraction with an adsorbent in the form of active carbon having at least one of calcium and a calcium compound supported thereon, thereby removing mercury from said fraction.

3. A method for removing mercury from a liquid hydrocarbon fraction which contains a component having a higher molecular weight than the desired hydrocarbon compound and an organic mercury compound, comprising the steps of:

(1-*a*) subjecting said fraction to heat treatment at a temperature of about 200° to 900° C. to convert the majority of the organic mercury compound into an inorganic mercury compound or elemental mercury, (a) then removing the higher molecular weight component from said fraction, and thereafter (c) contacting said fraction with an adsorbent in the form of active carbon having at least one of calcium and a calcium compound supported thereon, thereby removing mercury from said fraction.

4. A method for removing mercury from a liquid hydrocarbon fraction which contains some water and an organic mercury compound, comprising the steps of:

(1-*a*) subjecting said fraction to heat treatment at a temperature of about 200° to 900° C. to convert the majority of the organic mercury compound into an inorganic mercury compound or elemental mercury, (b) then removing water from said fraction, and thereafter (c) contacting said fraction with an adsorbent in the form of active carbon having at least one of calcium and a calcium compound supported thereon, thereby removing mercury from said fraction.

5. The method according to any one of claims 1 to 4 wherein said calcium compound is a calcium halide or calcium oxide.

6. The method according to any one of claims 1 to 4 wherein said active carbon has a particle size of 4 to 120 mesh.

7. The method according to any one of claims 1 to 4 wherein the step (1-*a*) is carried out in a thermal cracking furnace.

8. The method according to any one of claims 1 to 4 wherein said heat treatment (1-*a*) is carried out at a temperature of 400° to 900° C.

9. The method according to any one of claims 1 to 4 wherein said heat treatment (1-*a*) is carried out at a temperature of 700° to 900° C.

* * * * *